US010704185B2

(12) United States Patent
Lee et al.

(10) Patent No.: US 10,704,185 B2
(45) Date of Patent: Jul. 7, 2020

(54) APPARATUS FOR TREATING LAUNDRY

(71) Applicant: LG Electronics Inc., Seoul (KR)

(72) Inventors: Jongsung Lee, Seoul (KR); Jinbong Park, Seoul (KR); Yeongkyeong Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 227 days.

(21) Appl. No.: 15/886,181

(22) Filed: Feb. 1, 2018

(65) Prior Publication Data

US 2018/0216279 A1 Aug. 2, 2018

(30) Foreign Application Priority Data

Feb. 2, 2017 (KR) ..... 10-2017-0014837

(51) Int. Cl.

| | |
|---|---|
| ***D06F 39/02*** | (2006.01) |
| ***D06F 33/04*** | (2006.01) |
| ***D06F 37/04*** | (2006.01) |
| ***D06F 39/14*** | (2006.01) |
| *D06F 39/12* | (2006.01) |

(52) U.S. Cl.

CPC ..... *D06F 39/022* (2013.01); *D06F 33/04* (2013.01); *D06F 37/04* (2013.01); *D06F 39/02* (2013.01); *D06F 39/14* (2013.01); *D06F 39/12* (2013.01)

(58) Field of Classification Search

CPC ..... D06F 39/022; D06F 39/02; D06F 39/12; D06F 39/14; D06F 33/04; D06F 37/04

USPC ..... 68/12.18

See application file for complete search history.

(56) References Cited

FOREIGN PATENT DOCUMENTS

| | | |
|---|---|---|
| DE | 102005011046 | 5/2006 |
| DE | 202014102566 | 8/2014 |
| EP | 2281938 | 2/2011 |
| EP | 3064635 | 9/2016 |

OTHER PUBLICATIONS

European Search Report in European Patent Application No. 18154562.5, dated Aug. 10, 2018, 9 pages.

*Primary Examiner* — Tinsae B Ayalew

(74) *Attorney, Agent, or Firm* — Fish & Richardson P.C.

(57) ABSTRACT

A cabinet includes a front panel having an opening at a front side, a door seated on the front panel, the door having a diameter greater than that of the opening to open/close the opening, a control panel located at a top part of the front panel, the control panel defining a seating recess configured to seat a top part of the door and a draw hole at a lateral side of the seating recess, a detergent box drawably located in the draw hole and configured to receive detergent, a handle panel coupled to a front side of the detergent box, the handle panel including one side configured as an avoidant surface corresponding to a shape of an outer circumference of the seating recess, and a preventing part configured to prevent the avoidant surface from being spaced apart from the front side of the detergent box.

13 Claims, 6 Drawing Sheets

【FIG 1】
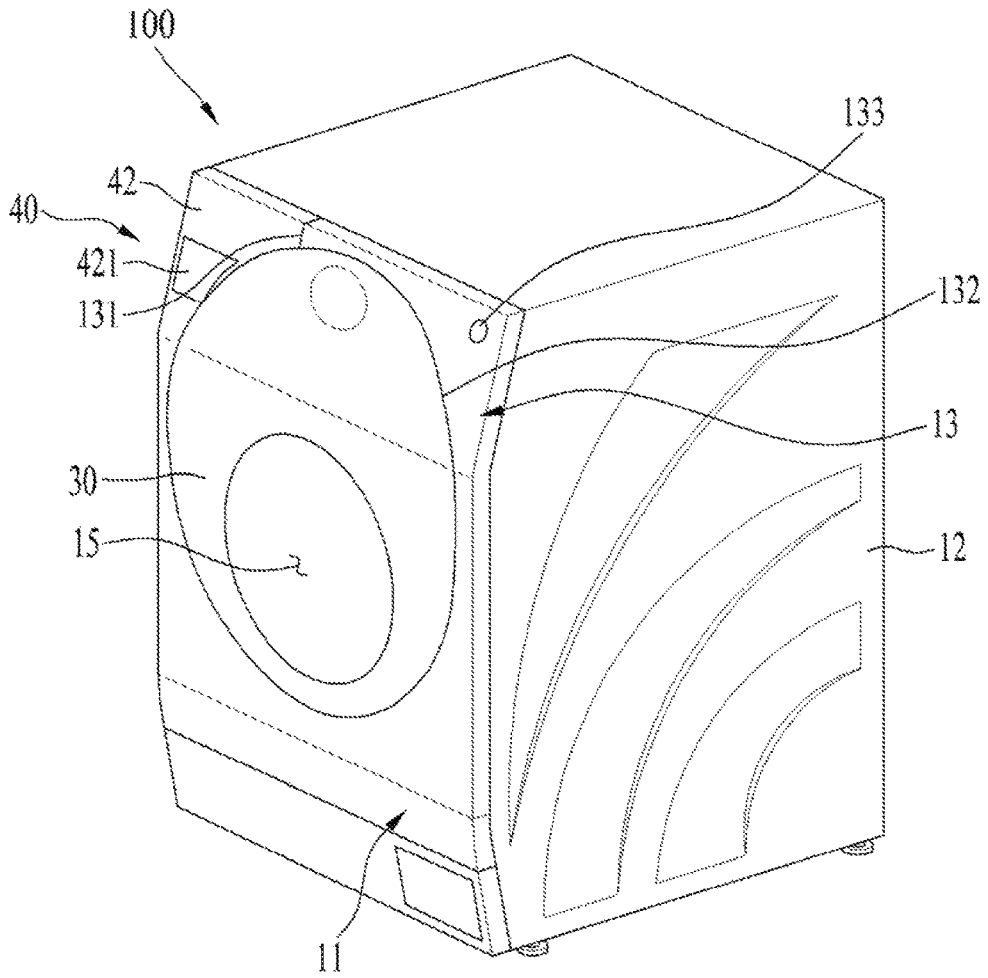

【FIG 2】
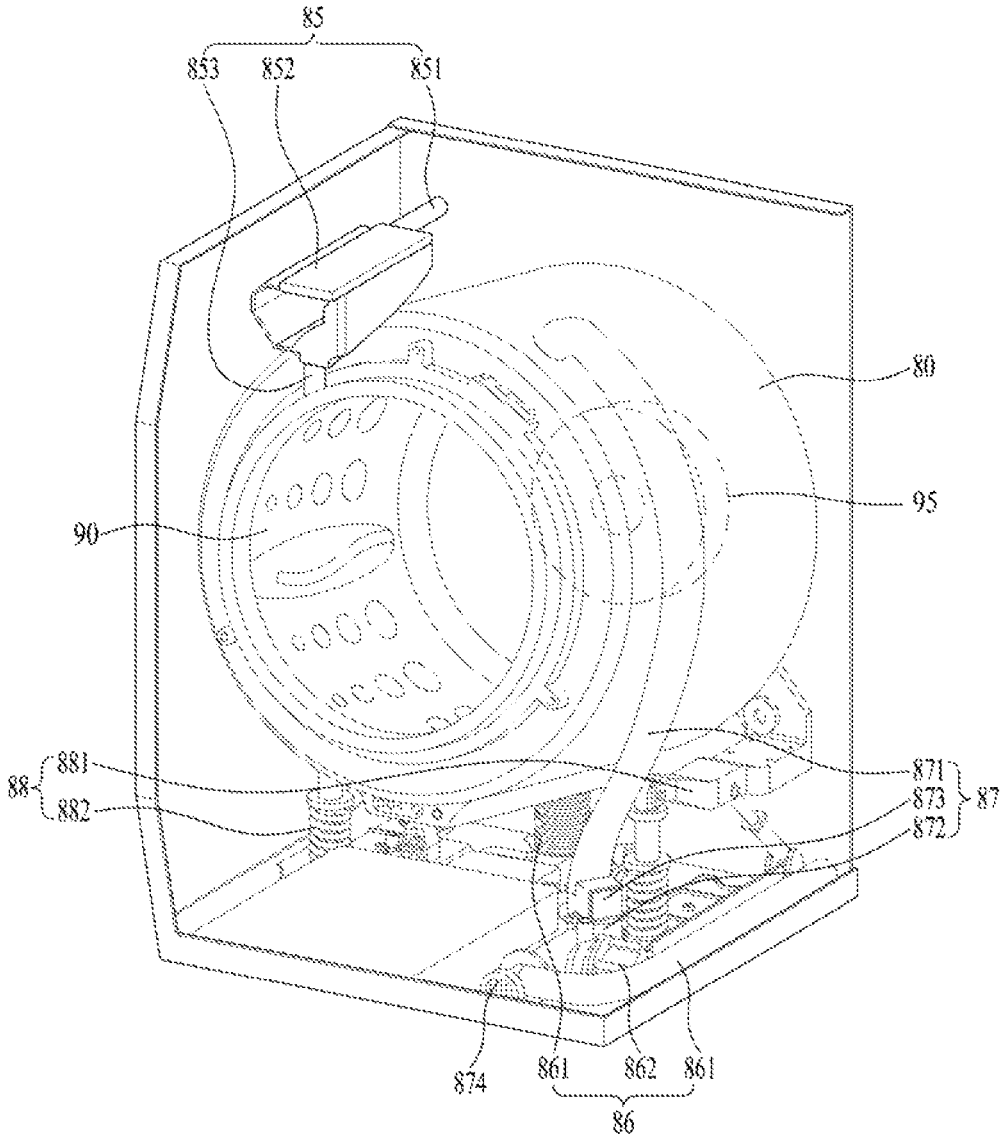

【FIG 3】
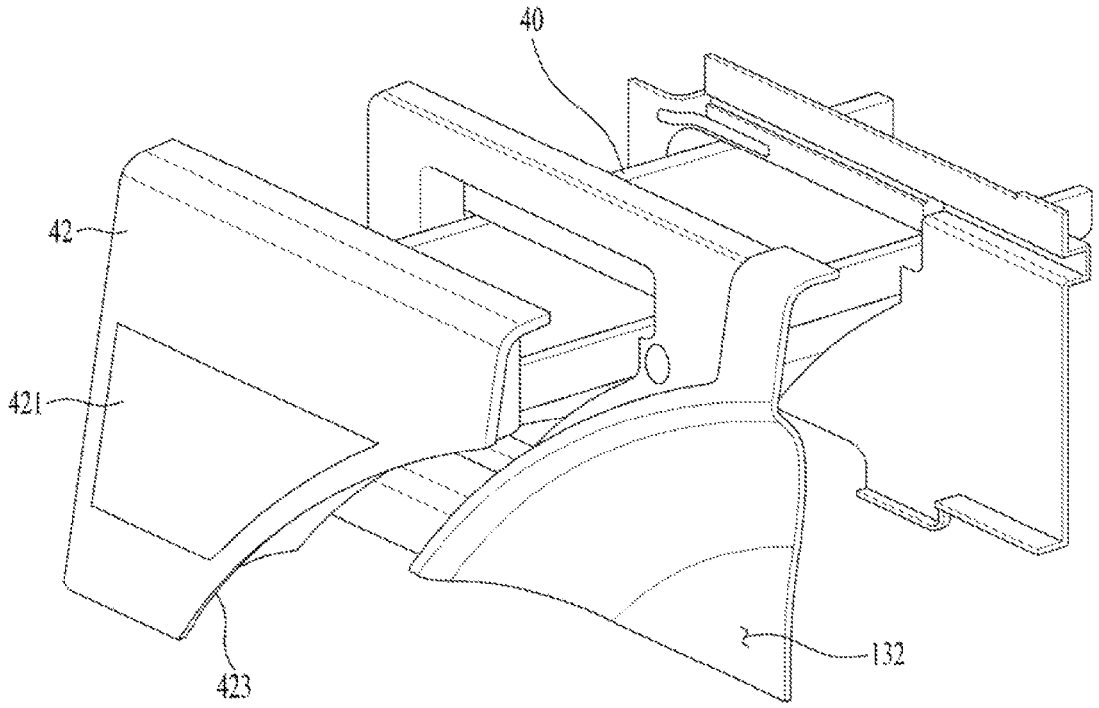

【FIG 4】
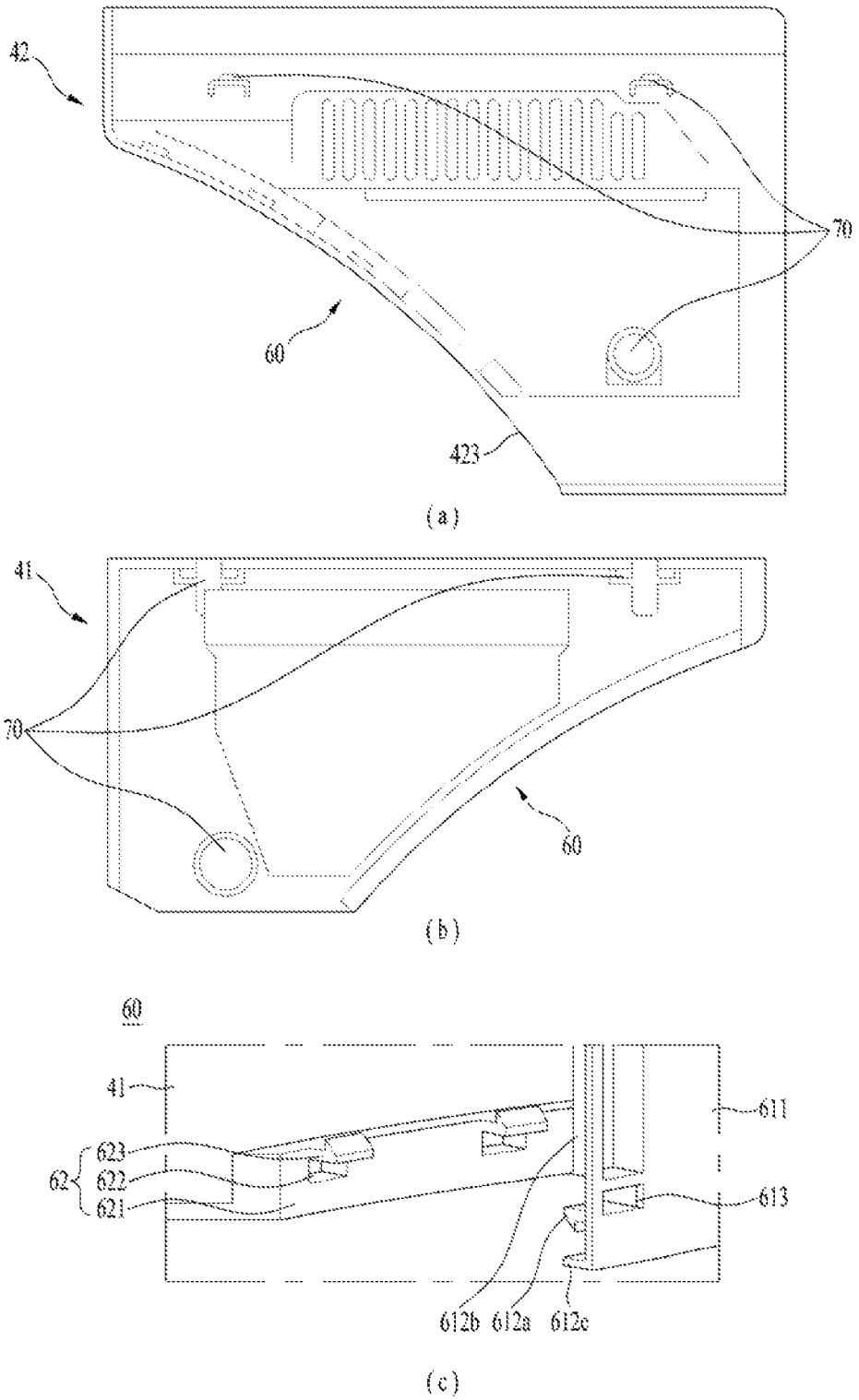

【FIG 5】
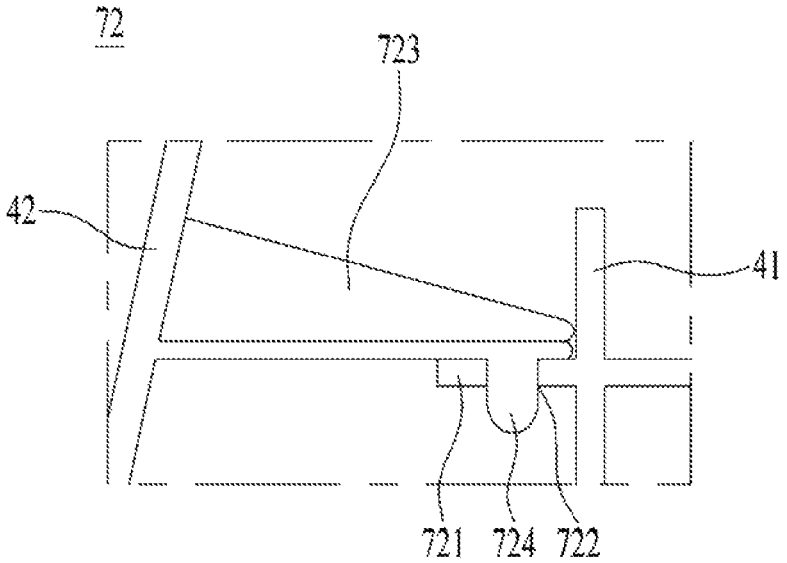
(a)
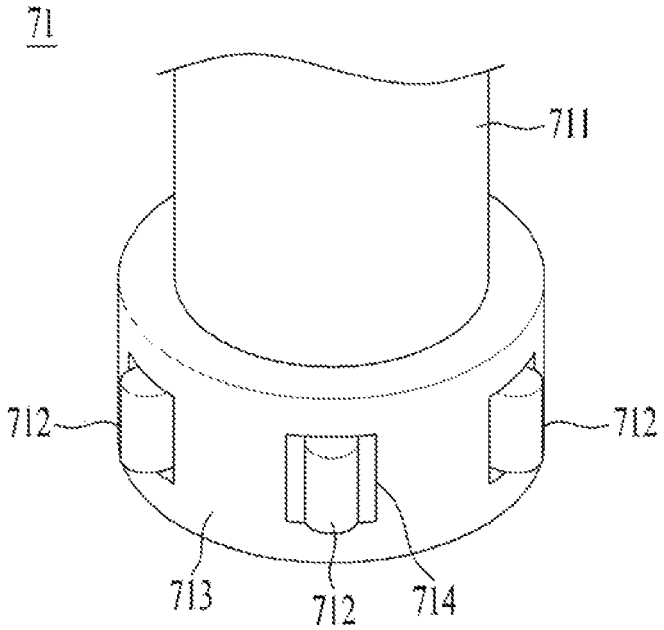
(b)

【FIG 6】
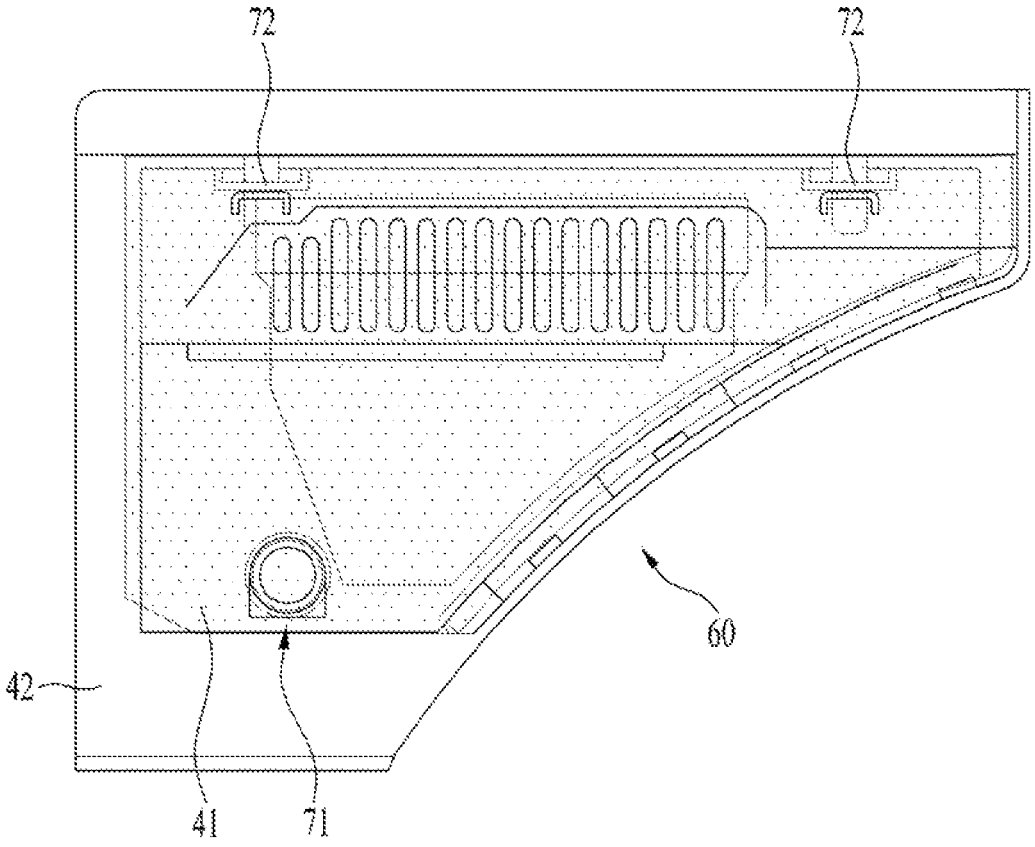

APPARATUS FOR TREATING LAUNDRY

CROSS-REFERENCE TO RELATED APPLICATION

Pursuant to 35 U.S.C. § 119(a), this application claims the benefit of earlier filing date and right of priority to Korean Application No. 10-2017-0014837, filed on Feb. 2, 2017, the contents of which are hereby incorporated by reference herein in their entirety.

BACKGROUND OF THE INVENTION

Field of the Invention

The present invention relates to an apparatus for treating laundry.

Discussion of the Related Art

Generally, a laundry treating device means a device capable of washing, drying, or washing & drying laundry and the like. Herein, the laundry treating device may perform a wash or dry function only, or may perform both of the wash and dry functions. Recently, a steam supplier equipped washer having a refresh function (e.g., wrinkle press-out, deodorization, static electricity removal, etc.) for laundry tends to come into wide use.

Meanwhile, the related art laundry treating devices are categorized into a front load type or a top load type according to a withdrawal direction of laundry. Particularly, a laundry treating device of a front type means a laundry treating device including an opening provided to a front side and a drum of which rotation axis is in parallel with a ground surface or has a predetermined inclination. And, a laundry treating device of a top load type means a laundry treating device including an opening provided to a top and a drum of which rotation axis is vertical to a ground surface.

Meanwhile, in a related art laundry treating device of a front type, an input unit and a display unit can be provided to a door for opening/closing an opening. As the door is formed of transparent material to see through an inside, if the input unit and the display unit are provided to the door using a display panel, a touch panel and the like, it is able to improve overall unity and aesthetic impression.

In the laundry treating device having the input and display units provided to the door, the door can have a diameter much greater than that of the opening to facilitate user's access to the input and display units.

As a center of the door inclines to be higher than a center of the opening, the top part of the door is further near a front top part of the laundry treating device.

Meanwhile, the related art laundry treating device can have a detergent box provided to a front top part of a cabinet so as to be pulled out in a front direction. As a handle panel having a handle is joined to a front side of the detergent box, a user can easily draw the detergent box from the cabinet by gripping the handle.

In this case, since the door has a relatively large diameter and is located near the front top part of the cabinet, the handle panel of the detergent box needs to be curved depending on a shape of an outer circumference of the door.

Here, since the handle panel is not formed in a rectangular shape, there is a problem that a force for joining the handle panel to the detergent box is weakened.

Moreover, although the handle panel is joined to the detergent box, when a user draws the handle provided to the handle panel, there is a problem that a portion of the handle panel designed to avoid is spaced apart from the detergent box.

Besides, when a user draws the handle panel, there is a problem that a curved portion of the handle panel is broken.

SUMMARY OF THE INVENTION

Accordingly, embodiments of the present invention are directed to a laundry treating apparatus that substantially obviates one or more problems due to limitations and disadvantages of the related art.

One object of the present invention is to provide a laundry treating apparatus, by which a joining force between a handle panel having a handle and a curved surface of an outer circumference and a detergent box is reinforced.

Another object of the present invention is to provide a laundry treating apparatus, by which the handle panel is prevented from being spaced apart from a front side of the detergent box despite that an external force of drawing externally is applied to the handle panel.

Technical tasks obtainable from the present invention are non-limited by the above-mentioned technical tasks. And, other unmentioned technical tasks can be clearly understood from the following description by those having ordinary skill in the technical field to which the present invention pertains.

Additional advantages, objects, and features of the invention will be set forth in the disclosure herein as well as the accompanying drawings. Such aspects may also be appreciated by those skilled in the art based on the disclosure herein.

To achieve these objects and other advantages and in accordance with the purpose of the invention, as embodied and broadly described herein, an apparatus for treating laundry according to one embodiment of the present invention includes a cabinet including a front panel having an opening formed in a front side, a door seated on the front panel, the door having a diameter greater than that of the opening so as to open/close the opening, a control panel provided to a top part of the front panel, the control panel having a seating recess for having a top part of the door seated thereon and a draw hole provided to a lateral side of the seating recess, a detergent box provided in the draw hole drawably to provide a space for receiving detergent therein, a handle panel joined to a front side of the detergent box, the handle panel having one side configured as an avoidant surface corresponding to a shape of an outer circumference of the seating recess, and a preventing part configured to prevent the avoidant surface from being spaced apart from the front side of the detergent box.

Preferably, the detergent box may include a coupling panel provided to the front side thereof so as to be joined to the handle panel and the preventing part may include a fastening portion provided to one of the coupling panel and the avoidant surface and a fixing portion provided to the other one of the coupling panel and the avoidant surface so as to be joined to the fastening portion.

More preferably, the fixing portion may include a fixing rib projected from the coupling panel and a plurality of fixing perforated holes by perforating the fixing rib in a manner of being spaced apart from each other along a shape of the avoidant surface and the fastening portion may include a fastening rib projected from the avoidant surface and a projection portion provided to the fasting rib so as to be joined to at least one of the fixing rib and the fixing perforated hole.

Here, the projection portion may include a projection hook projected from the fastening rib so as to be fixed by being inserted into the fixing perforated hole.

The projection portion may include a support projected from the fastening rib so as to come into contact with a free end of the fixing rib.

The support may be configured in a manner that one surface of the fastening rib is recessed from the avoidant surface to the free end of the fixing rib and that the other surface of the fastening rib is projected from the avoidant surface to the free end of the fixing rib.

The support may be configured in hexahedral shape.

More preferably, the projection portion may further include a block rib configured to enclose the fixing rib by extending from the free end of the fastening rib in a predetermined distance in parallel with the handle panel.

The fastening rib may further include a fastening perforated hole provided between the support and the projection hook by perforating the fastening rib and the fixing rib may further include a fixing hook projected between the fixing perforated hole and the free end of the fixing rib so as to be fixed by being inserted in the fastening perforated hole.

Preferably, the apparatus may further include a coupling portion joining the handle panel and the front side of the detergent box, the coupling portion including a main coupling portion spaced apart from the preventing part in a predetermined distance and an auxiliary coupling portion provided over the preventing part.

More preferably, the main coupling portion may include a projection projected from the handle panel, a projection hook projected from an outer circumference of the projection, a receiving portion provided to a front side of the coupling panel to receive the projection therein, and a hook coupling portion provided to an inner circumference of the receiving portion to be joined to the projection hook.

Here, the projection may be formed in shape of cylinder.

More preferably, the auxiliary coupling portion may include a support rib projected from the front side of the detergent box, a support perforated hole formed by perforating the support rib, an auxiliary rib projected from the handle panel toward the support rib, and an auxiliary hook projected from the auxiliary hole so as to be inserted in the support perforated hole.

More preferably, a plurality of the auxiliary coupling portions may be provided in a manner of being spaced apart from each other in a predetermined distance.

Accordingly, the present invention provides the following effects and/or advantages.

First of all, the present invention reinforces a joining force between a handle panel having a handle and a curved surface of an outer circumference and a detergent box.

Secondly, the present invention prevents the handle panel from being spaced apart from a front side of the detergent box despite that an external force of drawing externally is applied to the handle panel.

Effects obtainable from the present invention may be non-limited by the above mentioned effect. And, other unmentioned effects can be clearly understood from the following description by those having ordinary skill in the technical field to which the present invention pertains.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and wherein:

FIG. 1 is a perspective diagram of a laundry treating apparatus;

FIG. 2 is a diagram showing internal configuration of a laundry treating apparatus;

FIG. 3 is a diagram showing a manner of joining a detergent box and a handle panel together;

FIG. 4 is a diagram showing the configuration for reinforcing a joining force between a handle panel and a detergent box;

FIG. 5 is a diagram showing a complete state that a handle panel and a detergent box are joined together; and FIG. 6 is a diagram showing the configuration of joining detergent box and a handle panel together.

DETAILED DESCRIPTION OF THE INVENTION

Reference will now be made in detail to a laundry treating apparatus according to an embodiment of the present invention, examples of which are illustrated in the accompanying drawings. For the sake of brief description with reference to the drawings, the same or equivalent components may be provided with the same reference numbers.

The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

FIG. 1 is a perspective diagram showing an exterior of a laundry treating apparatus according to the present invention. FIG. 2 is an exploded diagram showing the internal configuration of a laundry treating apparatus according to the present invention.

Referring to FIG. 1, a laundry treating apparatus 100 according to the present invention may include a cabinet 10 forming an exterior.

The cabinet 10 may include a front panel 11 having an opening 15 on a front side thereof and a control panel 13 provided to a top part of the front panel 11.

The control panel 13 and the front panel 11 may form a front side of the cabinet 10.

The control panel 13 may have a power unit 133 of the laundry treating apparatus.

The laundry treating apparatus according to one embodiment of the present invention may include a detergent box 40 for inputting a detergent.

The detergent box 40 receives a detergent therein and may be provided to supply the detergent to a tub 80 described later.

The detergent box 40 is a part for inputting a detergent thereto each time a user washes laundry using the laundry treating apparatus or a detergent is required for the detergent box 40. Hence, the detergent box 40 is received in the cabinet 10 to supply a detergent in the course of a wash cycle for the laundry treating apparatus to wash laundry. If necessary, the detergent box 40 can be pulled out of the cabinet 10.

To this end, a draw hole 131 for inserting or drawing the detergent box 40.

A handle panel 42 having a handle 421 may be provided to a front side 41 of the detergent box 40. The handle panel 42 may be provided in parallel with the control panel 13 when the detergent box 40 is inserted in the draw hole 131.

Namely, if the detergent box 40 is fully inserted in the draw hole 131, the handle panel 42 and the control panel 13 can from a single plane or parallel planes.

The handle 421 is a part gripped by a user when the detergent box 40 is drawn in a front direction. Although the handle 421 may be projected from the handle panel 42, it is preferable that the handle 421 is not projected from the handle panel 42 in order to prevent a user's body from colliding with the handle 421 or to prevent laundry from being damaged by the handle 421 on which the laundry is caught.

Hence, the handle 421 may be provided in a manner of being recessed inward from the front side 41 of the detergent box 40.

Meanwhile, a door 30 for opening/closing the opening 15 may be joined to the front panel 11.

The door 30 can be rotatably joined to the front panel 11 through a hinge (not shown). The door 30 may be projected from the front panel 11, and have a front side formed of see-through material for looking into the door 30.

To a top part of the door 30, at least one of a display unit 31 displaying a state of the laundry treating apparatus according to one embodiment of the present invention, a input unit 32 receiving an input of an operation command of the laundry treating apparatus, and a controller 33 controlling a command for operating the laundry treating apparatus may be provided. The display unit 31 and the input unit may include a display unit or a touch panel.

Since a front side of the door 30 is formed of transparent material, an inside of the laundry treating apparatus 100 can be checked through the opening 15.

Here, the door 30 is configured to be turned at the cabinet 10 and occupies an area of most of the front side of the cabinet 10. Hence, if the display unit 31 and the input unit 32 are provided to the front side of the door 30, they can attract user's attention with ease. Hence, the user can easily check the display unit 31 and manipulate the input unit 32. And, aesthetic impression can be improved.

So to speak, the display unit 31 and the input unit 32 are provided not to the control panel 13 but to the door 30.

Meanwhile, the display unit 31 or the input unit 32 is preferably provided to the top part of the door 30. Since a user's height is greater than a height of the cabinet 10 in general, the display unit 31 and the input unit 32 can be easily recognized and accessed by a user.

Preferably, the door 30 has a diameter greater than that of the opening 15 and is seated on the front panel 11. Here, a center of the door 30 may be set higher than that of the opening 15. The top part of the door 30 may be also seated on the control panel 13 over the top end of the front panel 11.

Thus, as the door 30 occupies an area of most of the front side of the cabinet 10, it can attract user's attention easily. And, the top part of the door 30 can be further near a front top part of the cabinet 10. Eventually, as a user easily recognizes and accesses the input unit 32 or the display unit 31 provided to the tip side of the door 30, convenience is enhanced and aesthetic impression is maximized.

Meanwhile, the top part of the door 30 may include an incline surface toward an upper front direction. For example, as the top part of the door 30 is configured to have thickness getting thinner toward a top end, it can form the incline surface.

This is to maximally increase an angle between tall user's eyes and a top plane of the door 30. If such an angle is increased, it means that the user's eyes get closer to a direction vertical to the top plane of the door. Particularly, it means that the user can look down a top end and a bottom end of the top plane of the door at the almost same angle. Thus, the user can easily recognize the input unit 32 or the display unit 31 provided to the top part of the door 30.

Meanwhile, if the door closes the opening 15, since the top part of the door 30 faces an area to which the control panel 13 is provided, the control panel 13 may have a seating part 132 on which the top part of the door 30 can be seated.

The seating part 132 may include a recess formed along a shape of an outer circumference of the door 30 in a bottom part of the control panel 13.

Here, since the door 30 is seated on the seating part 132, the detergent box 40 and the draw hole 131 may be provided to one side of the control panel to prevent interference with the door 30.

Meanwhile, the detergent box 40 may be configured in a manner that an outer circumference is near the door 30 to increase a volume to the maximum.

Moreover, the handle panel 42 joined to the front side of the detergent box 40 may further include an avoidant surface 423 formed along a shape of the outer circumference of the door 30 by having one lateral side near the outer circumference of the door 30 [cf. FIG. 3].

FIG. 2 is a diagram showing internal configuration of a laundry treating apparatus.

A laundry treating apparatus according to one embodiment of the present invention may include a tub 80 provided within the cabinet 10 by having a space for storing water and an input entrance 81 communicating with the opening 15, a drum 90 rotatably provided to the tub 80 to receive laundry therein, and a drive unit 95 provided to a backside of the tub 80 to rotate the drum 90.

The laundry treating apparatus according to one embodiment of the present invention may further include a water supply unit supplying water to the tub 80, a drain unit 86 draining the water of the tub 80 from the cabinet 10, and a circulating unit 87 circulating the water of the tub 80.

The water supply unit 85 may include a water supply pope 851 connected to an external water supply source to supply water to the tub 80, a box housing 852 communicating with one end of the water supply pipe 851, the box housing 852 receiving the detergent box 40 therein, and a supply pipe 853 connecting the box housing 852 to one side of the tub 80 so as to supply at least one of water and detergent to the tub 80.

The box housing 852 may be provided as a space for mixing the detergent received in the detergent box 40 with water supplied from the water supply pipe 851 by receiving the detergent box 40 therein.

The drain unit 86 may include a drain pipe 861 draining water of the tub 80 and a drain pump 862 providing the power for discharging the water flowing in the drain pipe 861 from the cabinet 10.

The circulating unit 87 may further include a circulating pope 871 guiding the water flowing in the drain pipe 861 to the tub 80 again and a circulating pump 872 communicating with the circulating pipe 871 to provide the power for the water to flow into the circulating pipe 871.

A 3-way valve 873 maybe provided to a connected portion between the circulating pipe 871 and the drain pipe 861, and a filter 874 for filtering off particles from the water discharged from the tub 80 may be provided thereto.

The drive unit 95 may include a stator generating a rotating magnetic field by being fixed to a backside of the tub 80, a rotor rotated by the stator, and a rotation shaft connecting the rotor to the backside of the drum 90.

Yet, unlike the drawing, the drive unit 95 may include a motor, a driving pulley rotated by the motor, a driven pulley rotating a rotation shaft connected to the backside of the drum 90, and a belt.

Meanwhile, the tub 80 can be fixed to the cabinet 10 by a support structure 88.

The support structure 88 may include a suspension bracket 881 connected to the backside of the tub 80 and the drive unit 95 and a plurality of dampers 882 connecting the suspension bracket 881 to a bottom side of the cabinet 10.

And, a plurality of springs (not shown) for supporting the tub 80 may be further included.

The support structure 88 may employ any structure capable of attenuating vibration by supporting the tub 80 within the cabinet 10.

FIG. 3 is a diagram showing a manner of joining the detergent box 40 and the handle panel 42 together, and FIG. 4 is a diagram showing the handle panel 42 and the coupling panel 41 provided to a front side of the detergent box 40.

Referring to FIG. 3, the handle panel 42 may be joined to the front side of the detergent box 40, and the handle 421 may be provided to the handle panel 41.

The handle 421 may be provided by being recessed into the handle panel 42.

As shown in the drawing, the detergent box 40 may be very near an outer circumference of the seating part 132, and the handle panel 42 may have the avoidant surface 423 provided along a shape of the seating part 132 or a shape of an outer circumference of the door 30.

Referring to FIG. 4, the coupling panel 41 formed integrally with the detergent box 40 to be joined to the handle panel may be provided to the front side of the detergent box 40.

The coupling panel 41 and the handle panel 42 may be joined together through a coupling portion 70. Here, the coupling portion 70 may include a hook fastening mechanism.

If the handle panel 42 is formed in a rectangular shape, the coupling portion 70 may be provided near four corners of the rectangular shape. Namely, when a user pulls the handle panel 42, a transferred external force is evenly distributed to the coupling portion 70. Hence, the coupling portion 70 can be prevented from being broken.

Yet, if the handle panel 42 has the avoidant surface 423, although a plurality of the coupling portions 70 are provided, a joining force for the avoidant surface 423 to be joined to the coupling panel 41 may not be sufficient.

So to speak, if an external force generated from pulling the handle panel 42 gripped by a user is transferred to the avoidant surface 423, the avoidant surface 423 may be separated or spaced apart from the coupling panel 41.

Moreover, although the coupling portion 70 is provided to a portion of the avoidant surface 423, the avoidant surface 423 failing to have the coupling portion 70 may be separated or spaced apart from the coupling panel 41.

Therefore, if a considerable external force works on the handle panel 42, the avoidant surface 423 is bent on the coupling panel. In severe cases, the handle panel 42 may be possibly broken.

To prevent such problems, the laundry treating apparatus according to one embodiment of the present invention may include a preventing part 60 for preventing the avoidant surface 423 from being spaced apart from the front side of the detergent box or the coupling panel 41.

The preventing part 60 may include a fastening portion 61 provided to one of the coupling panel 41 and the avoidant surface 423 and a fixing portion 62 provided to the other of the coupling panel 41 and the avoidant surface 423 so as to be joined to the fastening portion 61.

FIG. 4 shows that the fixing portion 62 is provided to the coupling panel 41 and that the fastening portion 61 is provided to the handle panel 42.

Particularly, FIG. 4(*a*) shows a backside of the handle panel 42, FIG. 4(*b*) shows affront side of the coupling panel 41, and FIG. 4(*c*) shows the preventing part 60.

Referring to FIG. 4(*c*), the fixing portion 62 may include a fixing rib 621 projected from the coupling panel 41 and a plurality of fixing perforated holes 622 formed in the fixing rib 621 in a manner of being spaced apart from each other along a shape of the avoidant surface.

The fastening portion 61 may include a fastening rib 611 projected from the avoidant surface 423 and a projection portion 612 provided to the fasting rib 611 so as to be joined to at least one of the fixing rib 621 and the fixing perforated hole 622.

The projection portion 612 may include a projection hook 612*a* projected from the fastening rib 611 so as to be fixed by being inserted into the fixing perforated hole 622.

The projection hook 612*a* is fixed by being inserted in the fixing perforated hole 622, and a plurality of the projection hooks 612*a* and a plurality of the fixing perforated holes 622 are provided along the shape of the avoidant surface 423. Hence, the avoidant surface 423 can be firmly fixed to the coupling panel 41.

Meanwhile, the projection portion 612 may include a support portion 612*b* projected from the fastening rib 611 so as to come into contact with a free end of the fixing rib 621.

The support portion 612*b* is able to support the fixing rib 621 by coming into contact with the free end of the fixing rib 621.

Thus, it is able to prevent the projection hook 612*a* from being bent or broken when the fixing rib 621 excessively approaches the coupling panel 41.

And, the fixing rib 621 forming an outer circumference of the fixing perforated hole 622 is fitted between the support portion 612*b* and the projection hook 612*a*, thereby playing a role as a hook.

Namely, in the course of inserting the projection hook 612*a* into the fixing perforated hole 622, a portion of the fixing rib 621 is fitted between the support portion 612*b* and the projection hook 412*a*, thereby being double-joined.

Hence, as the fastening portion 61 and the fixing portion 62 are firmly joined together, even if any external force is applied to the avoidant surface 423, it is able to prevent the avoidant surface 423 from being spaced apart from the coupling panel 41.

Meanwhile, the support portion 612*b* may be configured in a manner that one surface of the fastening rib 611 is recessed from the avoidant surface 423 to the free end of the fixing rib 621 and that the other surface of the fastening rib 611 is projected from the avoidant surface 423 to the free end of the fixing rib 621.

Namely, the support portion 612*b* may be configured in a manner that a predetermined portion of the fastening rib 611 is bent.

Therefore, as an external force applied to the fastening rib 611 is distributed by the support portion 612*b*, the rigidity and durability of the fastening member 611 can be reinforced.

The support portion 612*b* may be formed in various shapes, and more particularly, in a rectangular shape to come into surface contact with the fixing rib 621.

Meanwhile, the fastening portion 61 may further include a block rib 612*c* configured to enclose the fixing rib 621 by extending from the free end of the fastening rib 611 in a predetermined distance in parallel with the handle panel 42.

Namely, the block rib 612*c* may come into contact with the backside of the coupling panel 41 when the fastening portion 61 is joined to the fixing portion 62.

Thus, the block rib 612*c* and the support portion 612*b* receive the fixing rib 621 therein by being joined to both ends of the fixing portion 62, thereby improving a joining force between the fastening portion 61 and the fixing portion 62.

Moreover, the block rib 612*c* prevents particles and detergent from being inputted to the fastening portion 61 and the fixing portion 62, thereby preventing the fastening portion 61 and the fixing portion 62 from being contaminated or preventing the joining force between the fastening portion 61 and the fixing portion 62 from being weakened.

Meanwhile, a space between the block rib 612*c* and one end of the support portion 612*b* is set smaller than a width of the fixing rib 621, thereby enabling the fixing rib 621 to be tightly fitted between the block rib 631 and the support portion 612*b*.

Namely, the projection portion 612 can be triply joined by the fixing portion 62 & the projection hook 621*a*, the support portion 612*b*, and the block rib 612*c*.

Therefore, it is able to prevent the avoidant surface 423 from being spaced apart from the coupling panel 41.

Meanwhile, the fastening rib 611 may further include a fastening perforated hole 613 provided between the support portion 612*b* and the projection hook 612*a* by perforating the fastening rib 611. And, the fixing rib 621 may further include a fixing hook 623 projected between the fixing perforated hole 622 and the free end of the fixing rib 621 so as to be fixed by being inserted in the fastening perforated hole 613.

The fixing hook 623 may be fixed by being inserted in the fastening perforated hole 613 when the projection hook 612*a* is inserted in the fixing perforated hole 622.

Therefore, the fastening portion 61 and the fixing portion 62 can be joined together more firmly.

Meanwhile, the coupling portion 70 may include a main coupling portion 71 spaced apart from the preventing part 60 in a predetermined distance and an auxiliary coupling portion 71 provided over the preventing part 60.

Since the avoidant surface 423 is firmly joined to the coupling panel 41 through the preventing part 60, the main coupling portion 71 may be configured to reinforce the joining force of a portion located in an opposite direction of the avoidant surface 423.

Moreover, since the preventing part 60 and the main coupling portion 71 firmly join the handle panel 42 and the coupling panel together, the auxiliary coupling portion 72 can subsidiarily join the coupling panel 41 and the handle panel 42 together so as to maintain the locations of the coupling panel 41 and the handle panel 42.

Of course, the coupling portion 70 may include either the main coupling portion or the auxiliary coupling portion 72.

Since the avoidant surface 423 is provided to one lateral side of the handle panel 42, the main coupling portion 71 may be spaced apart from the avoidant surface 423 in a predetermined distance.

The main coupling portion 71 may be provided to an upper part of the center of a portion of a lower surface of the handle panel 42 failing to have the avoidant surface 423 formed thereon.

The main coupling portion 71 should play a role in firmly joining the portion of the handle panel 42 failing to have the avoidant surface 423 formed to the coupling panel.

FIG. 5 shows a joining structure of the coupling portion 70 in detail.

The main coupling portion 71 may include a projection 711 projected from the handle panel 42, a projection hook 712 projected from an outer circumference of the projection 711, a receiving portion 713 provided to a front side of the coupling panel 41 to receive the projection 711 therein, and a hook coupling portion 714 provided to an inner circumference of the receiving portion 713 to be joined to the projection hook 712.

The projection 711 is formed in shape of cylinder. Preferably, the projection 711 is formed in shape of circular cylinder to reinforce durability.

Moreover, the receiving portion 713 is preferably formed in cylindrical shape capable of receiving the projection 711 therein.

This is to enable the main coupling portion 71 to have the durability capable of enduring an external force applied to the handle panel 42 sufficiently [cf. FIG. 5 (*b*)].

At least one projection hook 712 is projected from an outer circumference of the projection 711. The hook coupling portion 714 may be provided in a manner of perforating an inner circumference of the receiving portion 713 so as to enable the projection hook 712 to be locked by being inserted in the hook coupling portion 714.

The auxiliary coupling portion 72 may include a support rib 721 projected from a front side of the coupling panel 41, a support perforated hole 722 formed by perforating the support rib 721, an auxiliary rib 723 projected from the handle panel 42 toward the support rib 721, and an auxiliary hook 724 projected from the auxiliary rib 723 so as to be inserted in the support perforated hole 722.

In the auxiliary coupling portion 72, as the support rib 721 is provided to extend up to a top portion of the auxiliary rib 723, the support rib 721 can come into contact with a top side of the auxiliary rib 723.

Thus, the auxiliary coupling portion 72 can prevent the handle panel 42 from being separated from the coupling panel 41 by being rotated centering on a bottom part of the handle panel 42.

Besides, a plurality of the auxiliary coupling portions 72 may be provided in a manner of being spaced apart from a top part of the handle panel 42 in a predetermined distance [Refer to FIG. 5(*a*)].

FIG. 6 shows a state that the handle panel 42 is joined to the coupling panel 41.

Since the handle panel 42 and the coupling panel 41, are firmly joined together through since the preventing part 60 and the coupling portion 70, although an external force is applied, it is able to prevent the handle panel 42 from being separated from the coupling panel 41 or to prevent the avoidant surface 423 from being spaced apart from the coupling panel 41.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for treating laundry, comprising:

a cabinet including a front panel having an opening;

a door configured to be seated on the front panel and to open and close the opening, the door having a diameter greater than the opening;

a control panel that is located at an upper part of the front panel, the control panel defining:

a seating recess at a bottom part, the seating recess having a shape corresponding to an outer circumference of the door and being configured to seat an upper part of the door, and a withdraw hole provided beside the seating recess;

a detergent box that is configured to be withdrawn from the withdraw hole and that defines a space configured to accommodate detergent;

a handle panel coupled to a front side of the detergent box, the handle panel comprising an avoidant surface that is disposed at one side of the handle panel and that has a shape corresponding to an outer circumference of the seating recess;

a coupling panel disposed at the front side of the detergent box and coupled to the handle panel; and a preventing part that extends along the avoidant surface and that couples the avoidant surface of the handle panel to the detergent box to restrict the avoidant surface from being separated from the front side of the detergent box, wherein the preventing part comprises a fastening portion that is disposed at one of the coupling panel or the avoidant surface, and a fixing portion that is disposed at the other of the coupling panel or the avoidant surface and that couples to the fastening portion.

2. The apparatus of claim 1, wherein the fixing portion comprises a fixing rib projected from the coupling panel along a shape of the avoidant surface and a plurality of fixing perforated holes by perforating the fixing rib along a shape of the avoidant surface, and wherein the fastening portion comprises a fastening rib projected from the avoidant surface and a projection portion disposed at the fastening rib and configured to couple to at least one of the fixing rib or one of the plurality of fixing perforated holes.

3. The apparatus of claim 2, wherein the projection portion comprises a projection hook projected from the fastening rib and configured to insert into one of the plurality of fixing perforated holes.

4. The apparatus of claim 3, wherein the projection portion comprises a support portion projected from the fastening rib so as to come into contact with a free end of the fixing rib.

5. The apparatus of claim 4, wherein one surface of the fastening rib is recessed from the avoidant surface to the free end of the fixing rib, and another surface of the fastening rib is projected from the avoidant surface to the free end of the fixing rib.

6. The apparatus of claim 5, wherein the support portion is configured in hexahedral shape.

7. The apparatus of claim 4, wherein the projection portion further comprises a block rib configured to enclose the fixing rib by extending from the free end of the fastening rib in a predetermined distance in parallel with the handle panel.

8. The apparatus of claim 5, wherein the fastening rib further comprises a fastening perforated hole provided between the support portion and the projection hook by perforating the fastening rib and wherein the fixing rib further comprise a fixing hook projected between one of the plurality of fixing perforated holes and the free end of the fixing rib so as to be fixed by being inserted in the fastening perforated hole.

9. The apparatus of claim 1, further comprising a coupling portion joining the handle panel and the front side of the detergent box, the coupling portion comprising:

a main coupling portion spaced apart from the preventing part in a predetermined distance; and an auxiliary coupling portion provided over the preventing part.

10. The apparatus of claim 9, wherein the main coupling portion comprises:

a projection projected from the handle panel;

a projection hook projected from an outer circumference of the projection;

a receiving portion provided to a front side of the coupling panel to receive the projection therein; and a hook coupling portion provided to an inner circumference of the receiving portion to be joined to the projection hook.

11. The apparatus of claim 10, wherein the projection is formed in shape of cylinder.

12. The apparatus of claim 9, wherein the auxiliary coupling portion comprises:

a support rib projected from the front side of the detergent box;

a support perforated hole formed by perforating the support rib;

an auxiliary rib projected from the handle panel toward the support rib; and an auxiliary hook projected from the auxiliary rib so as to be inserted inand configured to insert into the support perforated hole.

13. The apparatus of claim 9, wherein the auxiliary coupling portion comprises a plurality of auxiliary coupling portions that are spaced apart from each other by a predetermined distance.

* * * * *